United States Patent [19]

Vaughn et al.

[11] 4,257,148

[45] Mar. 24, 1981

[54] FIBER TRANSFER METHOD

[75] Inventors: George L. Vaughn, Greer; John D. Hollingsworth, Greenville, both of S.C.

[73] Assignee: John D. Hollingsworth on Wheels, Inc., Greenville, S.C.

[21] Appl. No.: 21,153

[22] Filed: Mar. 16, 1979

Related U.S. Application Data

[63] Continuation of Ser. No. 824,828, Aug. 15, 1977, abandoned.

[51] Int. Cl.[3] ..... D01G 15/02; D01G 15/46

[52] U.S. Cl. ..... 19/98; 19/106 R

[58] Field of Search ..... 19/98, 99, 105, 106 R, 19/128

[56] References Cited

U.S. PATENT DOCUMENTS

| | | | |
|---|---|---|---|
| 718,261 | 1/1903 | Laurency | 19/106 R |
| 1,620,307 | 3/1927 | Walsh | 19/106 R |
| 1,862,542 | 6/1932 | Laurency | 19/106 R |
| 3,249,967 | 5/1966 | Varga | 19/98 X |
| 3,373,461 | 3/1968 | Bessette et al. | 19/98 |

FOREIGN PATENT DOCUMENTS

| | | | |
|---|---|---|---|
| 2181 | of 1859 | United Kingdom | 19/105 |
| 2540 | of 1870 | United Kingdom | 19/105 |
| 16744 | of 1887 | United Kingdom | 19/128 |

*Primary Examiner*—Louis Rimrodt
*Attorney, Agent, or Firm*—Bailey, Dority & Flint

[57] ABSTRACT

A fiber transfer apparatus is illustrated including a doffing and feeding apparatus wherein opened fibers after being condensed are doffed by the action of a doffing member and a drafting roll prior to being passed over the nose of a fixed plate from where they are immediately subjected to a carding action.

1 Claim, 2 Drawing Figures

FIBER TRANSFER METHOD

This is a continuation, of application Ser. No. 824,828, filed Aug. 15, 1977 now abandoned.

BACKGROUND OF THE INVENTION

When tandem carding was first developed, the thin carded web from a first card was simply fed to a second card which resulted in a cleaner, more acceptable web which could thereafter be spun into superior yarn. Later, the web of the first card was passed over a pair of transfer rolls and thence to the cylinder of a second card with improved results as illustrated in United States Letters Pat. No. 3,097,399. In practice, the web from a first card is passed between crush or pressure rolls and thence over suitable transfer rolls to the main cylinder of a second card. The web from the first card is not subjected to any appreciable condensing action prior to transfer to the main cylinder of the second card as described in United States Letters Pat. No. 3,249,967.

It is also known that fibers may be doffed from a clothed carding cylinder by passing same into a throat or opening formed by a thin member projecting between the clothed cylinder and a second roll placed in transfer relation thereto. This practice is illustrated in United States Letters Pat. No. 3,283,366. When employing such apparatus, the doffed web may be passed about the second roll and thence between a pair of rotatable nip rolls for further processing.

Accordingly, it is an important object of the present invention to provide an apparatus for readily transferring the carded web from a first carding apparatus to a second carding apparatus in an improved manner.

Another important object of the invention is to improve the quality of the carded web resulting from the action of a tandem card arrangement by increasing the carding action to which the web is subjected.

A further important object is to improve the passage of a web from one carding arrangement to another by more positively controlling the web during transfer and feeding.

SUMMARY OF THE INVENTION

It has been found that a unitary doffing and feeding apparatus may be employed wherein the opened or carded fibers are positively controlled during passage from one to the other permitting condensing of the web prior to doffing with subsequent feeding such as to permit a carding action as by the action of a lickerin roll of a subsequent carding apparatus.

BRIEF DESCRIPTION OF THE DRAWING

The construction designed to carry out the invention will be hereinafter described, together with other features thereof.

The invention will be more readily understood from a reading of the following specification and by reference to the accompanying drawing forming a part thereof, wherein an example of the invention is shown and wherein.

DESCRIPTION OF A PREFERRED EMBODIMENT

Figure 1:
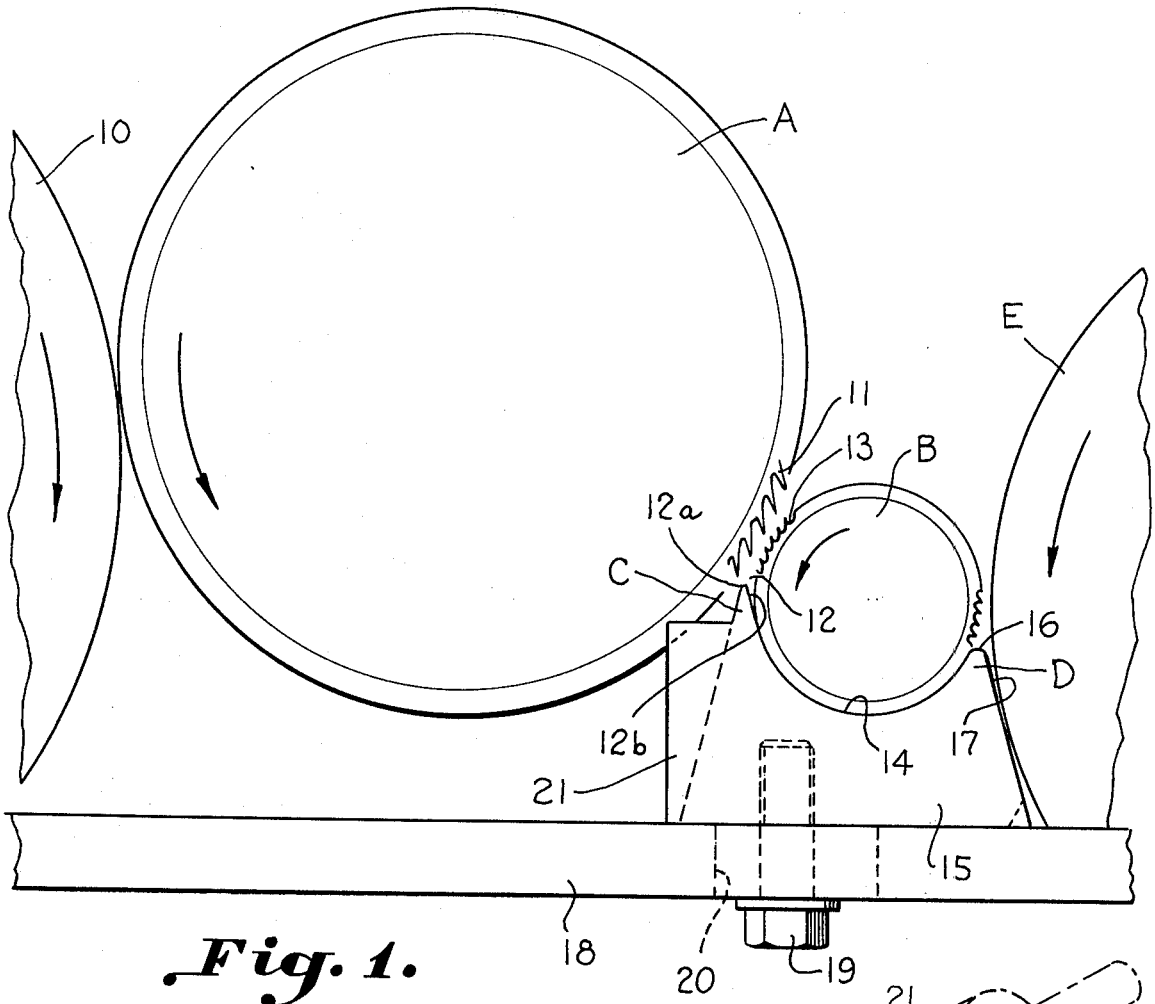
FIG. 1 is a longitudinal schematic elevation illustrating a unitary doffing and feeding apparatus constructed in accordance with the present invention positioned in conjunction with further apparatus in accordance with the invention for carrying out the method.
Figure 2:
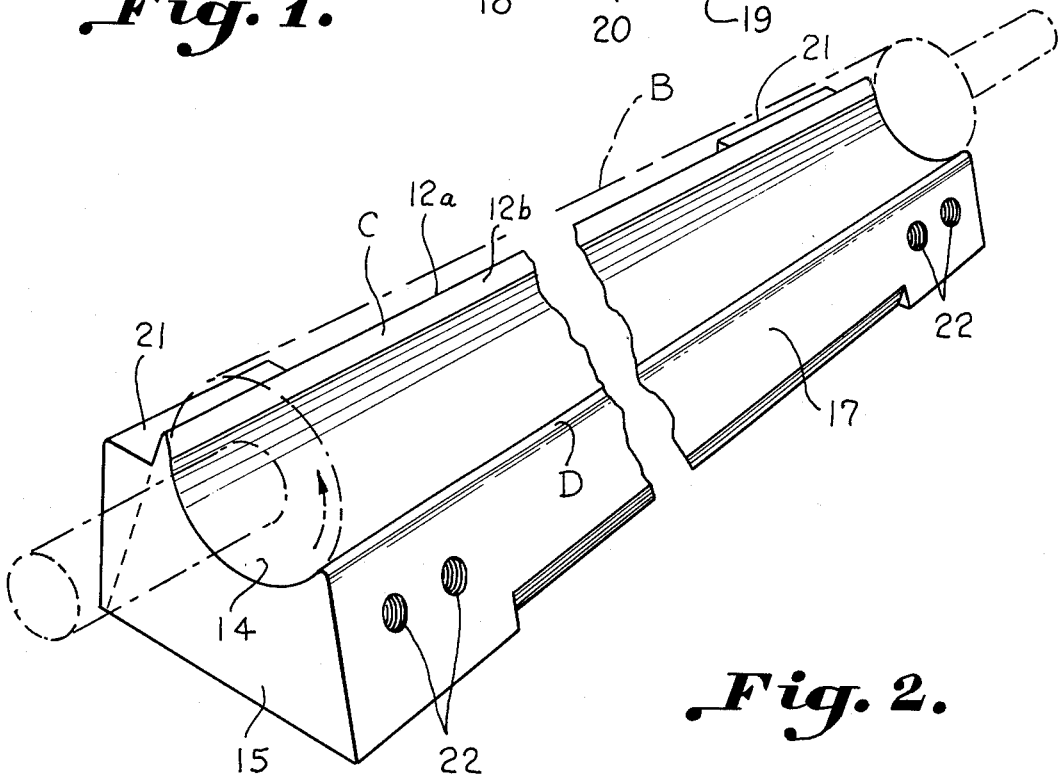
FIG. 2 is a perspective view further illustrating the unitary doffing and feeding apparatus.

The drawing illustrates an apparatus for transferring opened textile fibers from one carding element to another carding element. A condenser roll A receives a web of carded fibers. A drafting roll B is positioned adjacent the condenser roll in fiber transfer relation therewith. A member C is interposed between the condenser roll and the drafting roll forming a channel with the drafting roll opening toward the condenser roll for receiving fibers from said condenser roll. Feeding means including a nose D receives the fibers and feeds the fibers presenting them for receiving the carding action of another carding element E.

Referring more particularly to the drawing, a transfer roll is illustrated at 10 for receiving a thin carded web as from crush rolls of a prior carding arrangement. The roll 10 preferably has metallic card clothing and the thin web of fibers is doffed therefrom by the action of the condenser roll A which is provided with suitable metallic card clothing 11. For example, if the fiber stock of the carded web passing to the transfer roll 10 is 70 grans per square yard, the condenser roll may increase the thickness of the web on an 8 to 1 ratio resulting in a web or batt of 560 grains per square yard. The condensed web moves in the direction of the arrow on the condenser roll A and thence over the nose of the elongated blade-like member C passing into an opening which is enlarged at the entrance thereof as illustrated at 12.

The member C has a curved upper surface as illustrated at 12*a* which has been somewhat reduced by removing an inner portion thereof adjacent the roll B forming a flat surface 12*b* tapering inwardly toward the roll B. The member C thus tapers inwardly presenting a smooth pointed upper surface or lip.

The roll B is positioned in transfer relation to the roll A and provided with metallic card clothing 13. The action of the roll B may alone be sufficient to doff the condensed web from the condenser roll A, but in any case, is in such transfer relation with the roll A that the combined action of the roll B and the member C is sufficient to cause the web to pass into the opening 12 and thence through a fiber passageway or channel intermediate the member C and the nose D defined between the arcuate upper surface 14 of the unitary doffing and feeding apparatus which is formed integrally with the base block 15. For this purpose, for example, a setting of 0.005 inches may be maintained between the roll B and the arcuate surface 14. The drafting action of the roll B has been found to be satisfactory by employing a draft of from 10% to 100%, but in any event, the action should be sufficient to ensure transfer of the fibers from the condenser roll A. The roll B is illustrated as being provided with metallic card clothing 13 but such may be a simple metallic or fluted roll.

The fibers of the web or batt then pass from the passageway defined between the roll B and the arcuate surface 14 over the nose of the feeding member D where they are immediately presented to carding action of the roll E. The roll E is preferably provided with card clothing and may preferably be the lickerin of a subsequent carding apparatus. The nose D includes a gently curving or arcuate upper portion illustrated at 16 which joins a downwardly inclined flat surface 17 so that the point of tangency of the roll E with the downward sloping surface of the nose of the feed plate may be below the arcuate upper surface by an amount to exceed the length of the fibers being processed.

The unitary doffing and feeding member may be suitably positioned upon the frame 18 as by providing for reception of a bolt 19 which passes through a longitudinal slot 20 provided in the frame 18. The block 15 may be adjusted longitudinally along the rail in order to effect proper settings as through the use of threadable adjustment means of any desired type (not shown) secured to the integral lugs 21. In this connection it is standard practice to mount for rotation a longitudinal threaded member (not shown) extensible threadably into respective lugs 21 to provide the adjustment through such rotation. Suitable threadable adjustments may also be provided for effecting settings of the elements previously described one to the other. The roll B may be provided with a limiting stop to ensure the proper setting in relation to the arcuate surface 14 but which will permit yieldable upward movement as when accommodating a choke or other obstruction which passes beneath the drafting roll B and mounting holes 22 are provided on each side of the carding surface 17 for mounting bearings and associated structure (not shown) for this purpose.

Since a substantial amount of the cleaning action of a card occurs at the lickerin, the use of the lickerin of the subsequent carding arrangement produces a superior web. Where the thin web is transferred without condensing the later lickerin must be slowed down preventing such cleaning action. Since the fibers are positively controlled during transfer, they may be metered at a uniform rate during passage from one carding element to another. It has also been observed that the web may be self-threading into the subsequent card and there may be less tendency to inject chokes therein.

While a preferred embodiment of the invention has been described using specific terms, such description is for illustrative purposes only, and it is to be understood that changes and variations may be made without departing from the spirit or scope of the following claims.

What is claimed is:

1. The method of carding textile fibers including the steps of:

subjecting the fibers to the action of a first carding means delivering a thin carded web in open width;

providing a transfer roll;

subjecting the thin carded web to the action of said transfer roll;

providing a condensing roll adjacent said transfer roll;

subjecting said thin carded web to the action of said condenser roll forming a condensed web;

providing a doffing means;

doffing said condensed web roll;

providing a feed plate having a nose;

then passing the condensed web over the nose of said feed plate; and then subjecting the condensed web to the action of a clothed roll immediately after the fibers pass over the nose of the feed plate.

* * * * *